US006618871B2

(12) United States Patent
Kopacz et al.

(10) Patent No.: US 6,618,871 B2
(45) Date of Patent: Sep. 16, 2003

(54) SHOWER DOOR ASSEMBLY

(75) Inventors: Thomas H. Kopacz, Howards Grove, WI (US); Michael A. Kobilic, Fond du Lac, WI (US); Kristina J. Genslak, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/201,023

(22) Filed: Jul. 22, 2002

(65) Prior Publication Data

US 2003/0019030 A1 Jan. 30, 2003

Related U.S. Application Data

(60) Provisional application No. 60/307,555, filed on Jul. 24, 2001.

(51) Int. Cl.[7] ..... A47K 3/36

(52) U.S. Cl. ..... 4/607; 4/605; 4/614; 49/381

(58) Field of Search ..... 4/605, 607, 610, 4/612, 613, 614; 49/381, 398

(56) References Cited

U.S. PATENT DOCUMENTS

| | | | | | |
|---|---|---|---|---|---|
| 2,698,677 | A | * | 1/1955 | Tadd | 49/381 X |
| 2,923,036 | A | | 2/1960 | Beyrle | 49/388 |
| 4,035,957 | A | | 7/1977 | Roloff | 49/388 |
| 4,286,343 | A | | 9/1981 | Lampka | 4/607 X |
| 4,720,876 | A | | 1/1988 | Tomei et al. | 4/607 X |
| 4,887,394 | A | | 12/1989 | Marlowe | 49/409 |
| 5,033,132 | A | | 7/1991 | Greenblatt | 4/607 X |
| 5,063,638 | A | | 11/1991 | Howard et al. | 49/398 X |
| 5,205,072 | A | | 4/1993 | Eutebach | 49/381 |
| 5,671,488 | A | * | 9/1997 | Greferath | 4/607 |
| 5,822,810 | A | | 10/1998 | Chen | 4/610 |

FOREIGN PATENT DOCUMENTS

| | | | | |
|---|---|---|---|---|
| DE | 3008228 | * | 9/1981 | 4/607 |
| FR | 2629996 | * | 10/1989 | 4/610 |
| FR | 2693095 | * | 1/1994 | 4/607 |
| WO | 8801843 | * | 3/1988 | 4/607 |

* cited by examiner

*Primary Examiner*—Robert M. Fetsuga
(74) *Attorney, Agent, or Firm*—Quarles & Brady LLP

(57) ABSTRACT

A shower door assembly includes a swingable door panel mounted to a stationary side enclosure panel by a pair of hinge assemblies that are transversely adjustable to correct for out-of-plumb conditions. The hinge assemblies include pocketed stationary hinges capping the ends of the side panel and moveable hinges mounted to the door panel in a slidable slot and pin connection. The side panel is mountable to an enclosure wall by an upright wall jamb defining a track in which can slide a jamb pin disposed through the side panel. The wall jamb is shorter than the side panel and mounts accessory attachments at its upper end, such as a robe hook and a razor holder.

14 Claims, 6 Drawing Sheets

SHOWER DOOR ASSEMBLY

CROSS-REFERENCE TO RELATED APPLICATION

This application claims the benefit of U.S. Provisional Patent Application No. 60/307,555, filed Jul. 24, 2001.

STATEMENT OF FEDERALLY SPONSORED RESEARCH OR DEVELOPMENT

Not applicable.

BACKGROUND OF THE INVENTION

The present invention relates to shower (e.g. shower/tub) enclosure door systems, and in particular to adjustable hinges and accessory mounting systems for use therewith.

Shower/tub enclosures typically have a back wall, end walls, and an opening therebetween. To prevent water from splashing onto the bathroom floor when showering, the opening is ordinarily closed by a curtain or door(s). For some of these systems, two or more doors slide transversely relative to each other (by-pass door systems). See e.g. U.S. Pat. No. 4,887,394. In other systems, one or more doors pivot open via hinges along their side. See e.g. U.S. Pat. No. 5,417,272.

Premade plastic enclosures leave openings of standard dimensions. However, various other enclosures are created using room walls that are tiled or otherwise protected. Such constructions may leave a non-standard size opening, or opening with sides that are not precisely parallel to each other, or are out-of-plumb.

Some shower door systems have been developed that allow the doors to be mounted in shower enclosure openings within a range of dimensions. See e.g. U.S. Pat. Nos. 4,286,343; 5,033,132 and 5,822,810. However, the systems described in these patents are most suitable for use with collapsible screens or curtains, rather than rigid door panels (either pivoting or by-pass).

U.S. Pat. No. 4,035,957 provides a shower door system with a frame that can be adjusted to support a pivoting door panel. The upper and lower cross-members have telescoping profiles that can be moved relative to each other as needed to vary the overlap between a fixed panel and the pivoting door panel. However, this system requires a relatively heavy frame.

U.S. Pat. No. 5,063,638 discloses a hinge assembly for pivotable shower door panels, providing out-of-plumb adjustment for the door panel. This assembly is rather complex, and requires the hinge to be fastened directly to the enclosure wall once in the desired position.

Another problem with door systems for shower enclosures arises with partially tiled enclosure walls or one-piece tub and shower surround units having walls that do not extend the full height of the enclosure. When the upright wall jambs of conventional shower door systems are mounted flush against such tile or surround unit walls, the upper end will extend beyond the top of the tile or surround unit. This creates an unsightly gap. In such cases, the gap has to be filled in some way, such as by building out the wall or bending the jamb.

In conventional bathrooms, robe hooks are typically mounted on the bathroom wall, thus disturbing the wall, and making repainting or changing of wall papering more difficult. Razors that are used in a shower also require a suitable place for their storage. Currently, they are either stored in a drawer or closet between uses (relatively inconvenient locations), or they are hooked on relatively unstable "shower caddies" that are hung from the shower outlet pipe. Thus, an improved shower door system, and an accessory mounting system for used therewith, is needed.

SUMMARY OF THE INVENTION

In one aspect the invention provides a shower door assembly. There is a pivotable door panel, a side enclosure panel, an upper connector hinge element, a lower connector hinge element, an upper transversely movable hinge element, and a lower transversely movable hinge element. Two of the hinge elements are mounted to the pivotable door panel, and the other two of the hinge elements are mounted to the side enclosure panel. One of the upper hinge elements is on an upper portion of one panel, the other of the upper hinge elements is on an upper portion of the other panel, and the upper hinge elements are pivotably connected to each other. Similarly, one of the lower hinge elements is on a lower portion of one panel, the other of the lower hinge elements is on a lower portion of the other panel, and the lower hinge elements are pivotably connected to each other. The shower door panel is pivotably mounted relative to the side enclosure panel so it can pivot about an essentially vertical axis relative to the side panel.

In the most preferred form, the connector hinge elements are both on the side enclosure panel and the transversely movable hinge elements are both on the shower door panel. Adjustment of the transversely movable hinge element can correct for out of plumb conditions, or variances in the size of the enclosure.

In another preferred form at least one of the transversely moveable hinge elements is in the form of a sub-assembly of a T-nut, a backing plate, and a hinge body having a pivot pin receiver and a T-cross section slot closed at one end and open at an opposite end. There can also be a cover for concealing the backing plate, and a pair of pivot pins, one of the pivot pins cooperating with the upper hinge elements, and the other of the pivot pins cooperating with the lower hinge elements. Each of the hinge elements has recesses for receiving a pivot pin.

Both of the connector hinge elements can have a vertically extending pocket for receiving an edge of the side enclosure panel. Also, preferably, the side enclosure panel and door panel at least partially overlap.

The assembly can also have an upright wall jamb mountable to a wall of a shower enclosure. The wall jamb extends to a height less than the side enclosure panel, and preferably has at least one accessory mounted adjacent an upper end of the wall jamb on the wall jamb. The accessory has an end matable with an inner profile of the wall jamb. In an especially preferred form the accessory has a robe hook extending in a first direction relative to the wall jamb, and a razor holder extending in an essentially opposed direction relative to the wall jamb.

In yet another form, the wall jamb has an upright track and the side enclosure panel has an opening in which is disposed a jamb pin slidably engaging the track.

The invention can also be viewed as providing a wall jamb for a shower door assembly. The jamb has a vertically extending main body region having an upper end, a hook mounted to the jamb adjacent its upper end so as to extend in a first direction, and a holder mounted to the jamb adjacent its upper end so as to extend in a second direction essentially opposite the first direction. The hook and holder are thus mounted in a compact back-to-back relationship to each other on the wall jamb, without the need to mount anything relating to the accessory to the shower outlet or bathroom walls outside the enclosure area.

The present invention thus provides a shower door assembly that can be mounted in enclosure openings of various widths (by modifying the amount of panel overlap). In this regard, the hinge assemblies allow for adjustment of the door panel with respect to the side panel throughout the adjustment range defined by the length of the slots in the hinge bodies and backing plates.

Another advantage of the invention is that it provides a shower door assembly that can be adjusted to correct for out-of-plumb installations. The hinge assemblies are independently adjustable.

Another advantage of the invention is to provide a shower door assembly that can be installed in enclosures with partially tiled walls or one-piece shower/tub surround modules which are shorter than the full height of the enclosure opening. The wall jamb is shorter than the panels and conventional surround units, and thus can be fastened directly to the tile or shorter surround units without creating a gap, or requiring bending of the jamb.

Still another advantage of the present invention is to provide a unique location for mounting accessories, particularly multiple accessories.

The assembly is also easy to install quickly. The door assembly can be mounted by fastening the upright wall jamb to an enclosure wall and sliding the jamb pin into the track. No tools are necessary to mount the side panel.

These and other advantages of the invention will be apparent from the detailed description and drawings.

DETAILED DESCRIPTION OF THE PREFERRED EMBODIMENT

Figure 1:
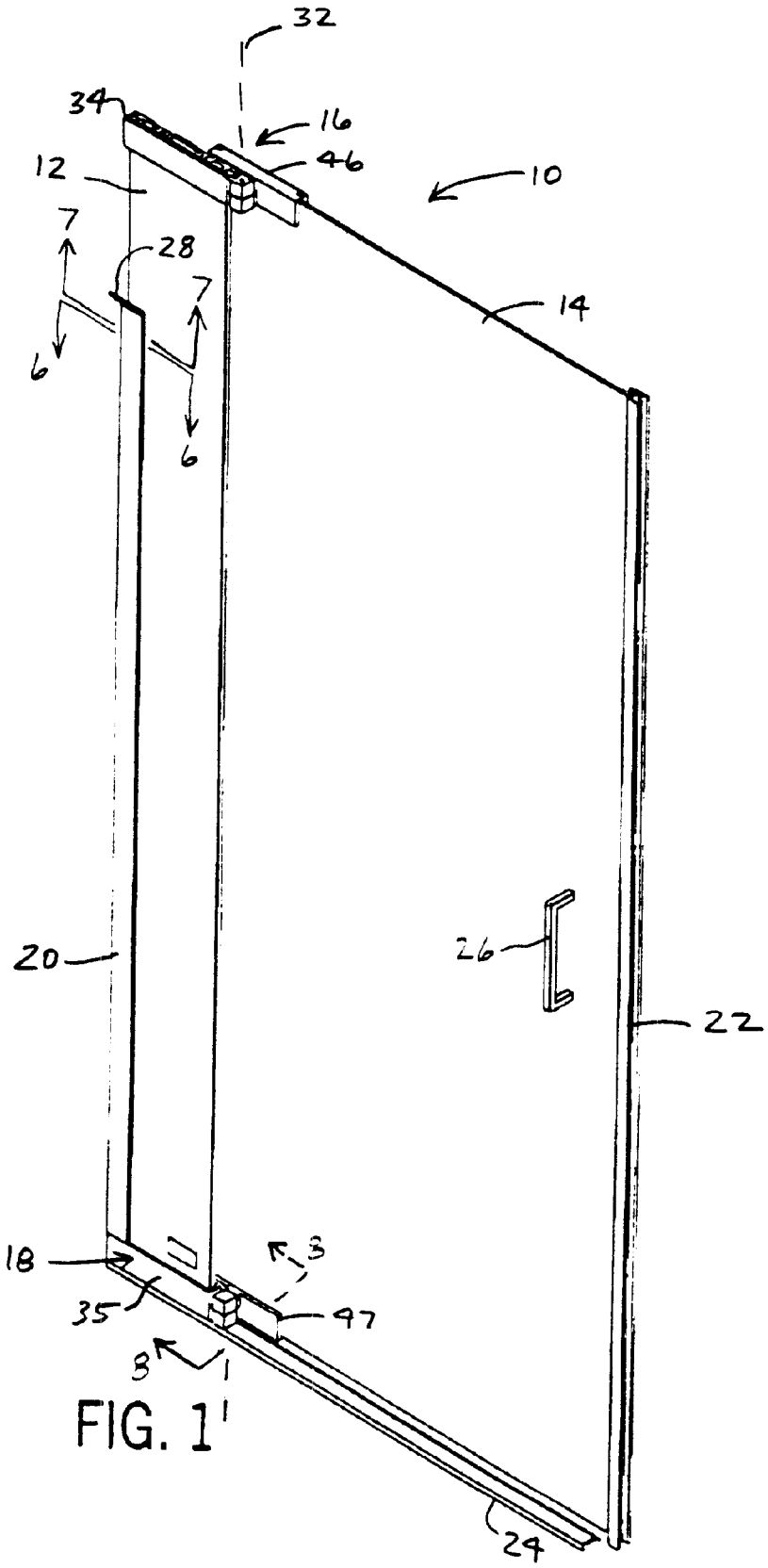
FIG. 1 is a perspective view of a shower door assembly of the present invention.
Figure 2:
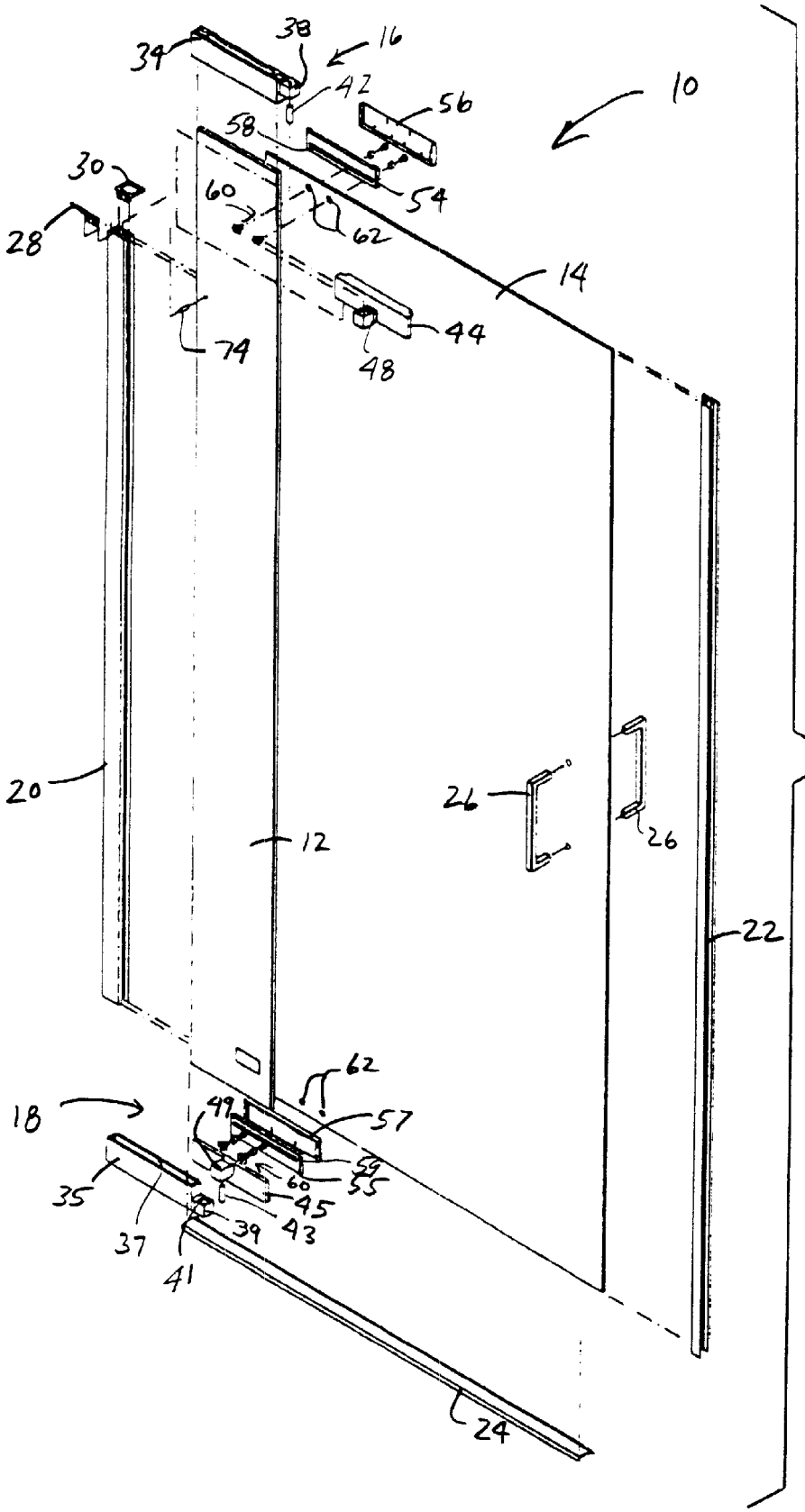
FIG. 2 is an exploded perspective of the assembly.

Referring first to FIGS. 1 and 2, the invention provides a shower door assembly 10 for controlling access to a shower (e.g. a shower or shower/tub enclosure). The door assembly 10 includes as primary components a side enclosure panel 12, a door panel 14, upper 16 and lower 18 hinge assemblies and an upright wall jamb 20. The door assembly 10 also includes the usual striker 22, threshold 24 and handle 26. In accordance with the present invention, there are also accessory attachments such as a robe hook 28 and a razor holder 30.

The door 14 pivots about a pivot axis 32 to open and close the enclosure opening. In the embodiment shown in the drawings, the door panel 14 rotates towards the reader to open the door.

Figure 3:
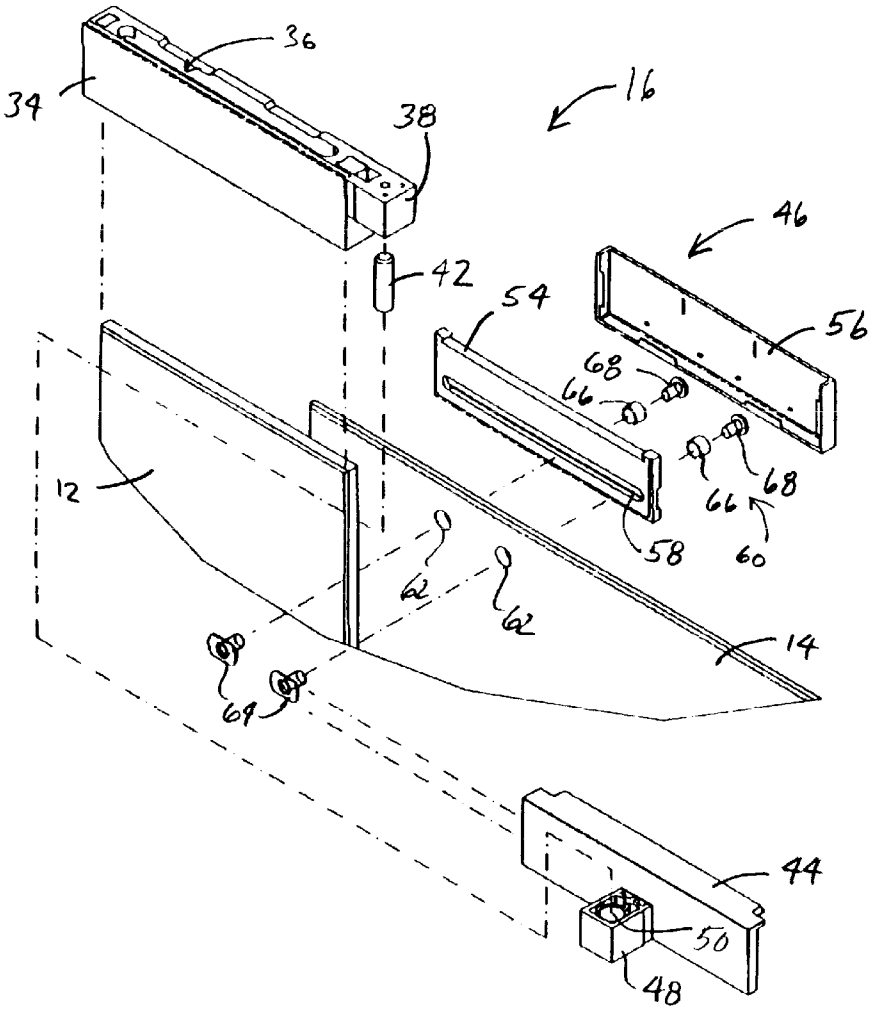
FIG. 3 is a partial exploded view of an upper hinge assembly.
Figure 4:
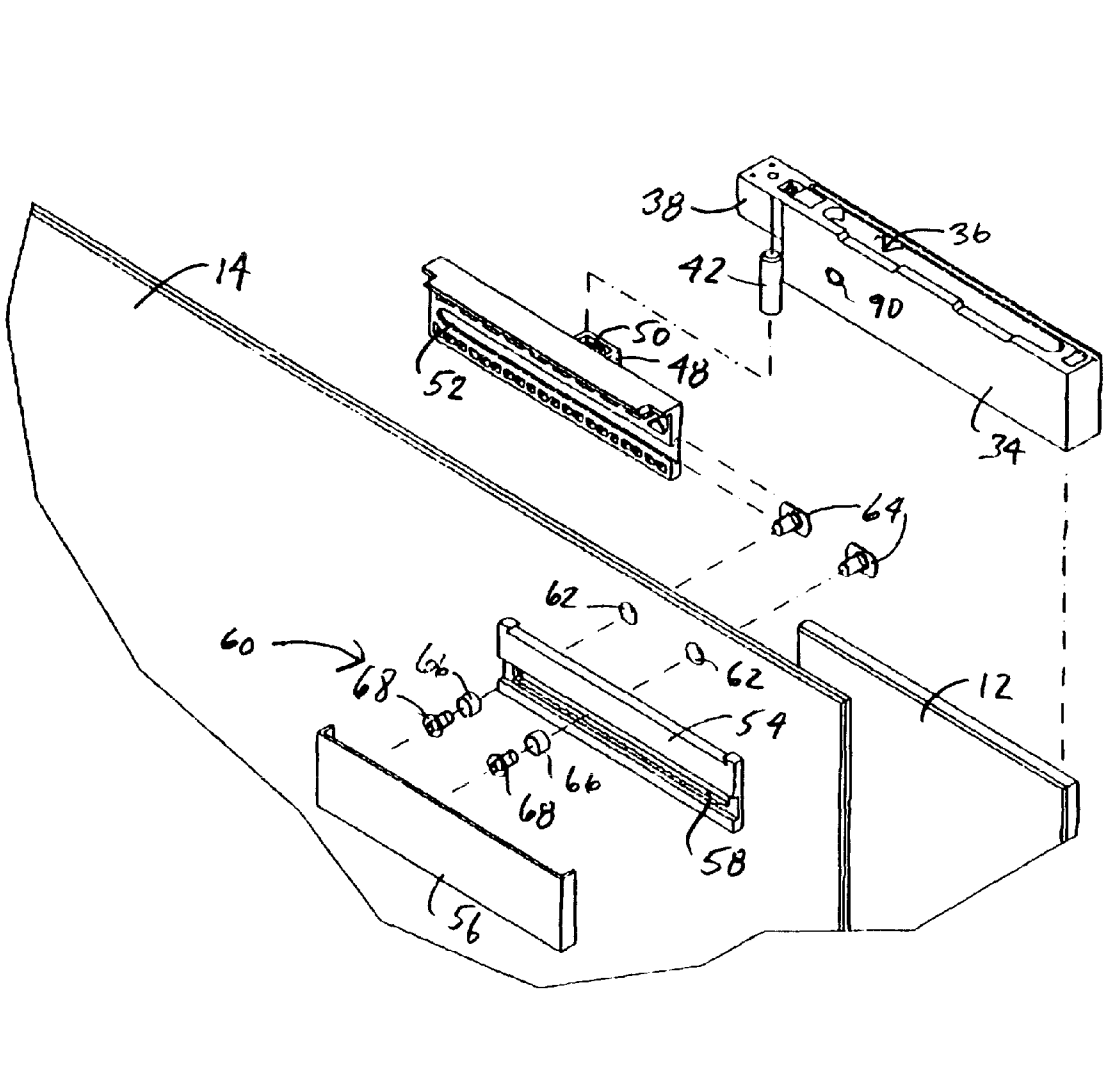
FIG. 4 is similar to FIG. 3, albeit it is a view taken primarily from the rear.

Referring next to FIGS. 2–4, the upper 16 and lower 18 hinge assemblies each includes respective stationary hinge elements 34 and 35 having elongated pockets 36 and 37 sized to receive respective ends of the side panel 12. Both of the stationary (connector) hinge elements 34 and 35 are preferably fixed in place on the side panel by a set screw (not shown) threaded into a bore (see e.g. 90 in FIG. 4) in a back side (facing the inside of the enclosure) of the stationary hinges 34 and 35 and tightened against the side panel 12.

The stationary hinges 34 and 35 have respective portions 38 and 39 at inner ends with pin recesses (see e.g. 41 in FIG. 2) positionable concentric with the pivot axis 32, in which respective pivot pins 42 and 43 are disposed. The recess of pivot 38 opens downwardly and the recess 41 of pivot 39 opens upwardly. The stationary hinge elements 34 and 35 may also kept in place by gravity as well as screws (not shown) threaded through the bottom (or top) of the pivot recesses into the threshold 24 or the ceiling of the enclosure.

The stationary hinge elements 34 and 35 pivotably couple to bodies 44 and 45 of transversely (towards and away from the jamb) moveable hinge sub-assemblies 46 and 47. The hinge bodies 44 include corresponding parts 48 and 49 with oppositely opening pivot recesses (see e.g. 50 in FIG. 3), preferably near their lateral centers. They are positioned concentric with the pivot axis 32 to receive the opposite ends of the pivot pins 42 and 43, and to form a pivotal connection with the stationary hinge elements 34 and 35, respectively. The back sides of the hinge bodies 44 and 45 include elongated lateral T-slots 52 and 53 (see FIGS. 4 and 8) that open at their laterally outer ends and are closed at the opposite ends.

Figure 8:
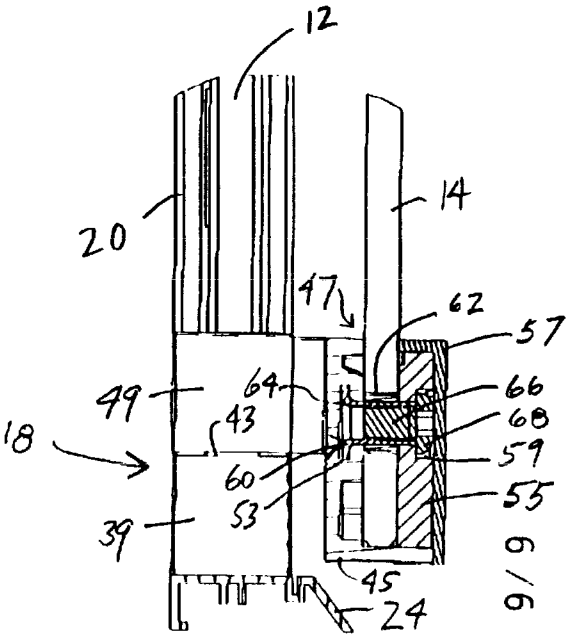
FIG. 8 is a partial cross-sectional view taken along line 8—8 of FIG. 1.

Referring next to FIGS. 3, 4 and 8, the transversely moveable hinge sub-assemblies 46 and 47 further include respective backing plates 54 and 55 and covers 56 and 57. The backing plates 54 and 55 have respective elongated lateral slots 58 and 59 sized and positioned to correspond to the T-slots 52 and 53, respectively. The backing plates 54 and 55 are mounted to the back side of the door panel 14 and the hinge bodies 44 and 45 are mounted to the front side of the door panel 14 with two pairs of fastening assemblies 60 disposed through two pairs of openings 62 in the upper and lower ends of the door panel 14.

Each fastening assembly 62 includes a T-nut 64, a bushing 66 and a bolt 68. The bushings 66 fit around the bolts 68 and ride within the slots 58 and 59 through the backing plates 54 and 55. The bolts 68 thread into the T-nuts 64, which are inserted into the openings 62 of the door panel 14 from the front. The T-nuts 64 have enlarged heads and narrow bodies. The narrow bodies fit inside the openings 62 and the enlarged heads slide into and within the T-slots 52 and 53 in the hinge bodies 44 and 45. Thus, the fastening assemblies 60 remain fixed in location with respect to the door panel 12. The respective hinge bodies 44 and 45 and backing plates 54 and 55 are also connected together via tongue and groove connections above and below the edges of the door panel 14.

The hinge bodies 44 and 45 and backing plates 54 and 55 can be slid as one transversely on the fastening assemblies 60 to adjust the lateral position of the door panel 14 with respect to the side panel 14. The lateral dimension of the door assembly 10 can thereby be varied to accommodate a range of enclosure opening dimensions. In particular, each hinge assembly 16 and 18 can be adjusted independent of the other so that the door panel 14 can be skewed from top to bottom as needed to align the door panel 14 with out-of-plumb enclosure walls. When the door panel 14 is in the proper position, the hinge assemblies 16 and 18 are secured in place by tightening the bolts 68. The covers 56 and 57 are slid onto the respective backing plates 54 and 55 and snapped in place by the fit of catch tabs (see 88 in FIG. 3) into a groove (see 90 in FIG. 3) around the periphery of the backing plates.

The hinge assemblies 16 and 18 provide for adjustments throughout the adjustment range defined by the length of the slots 52–55. Moreover, the overlap of the side 12 and door 14 panels allows the position of the door panel 14 to be adjusted without creating a lateral gap between the panels through which water could splash during showering.

Figure 5:
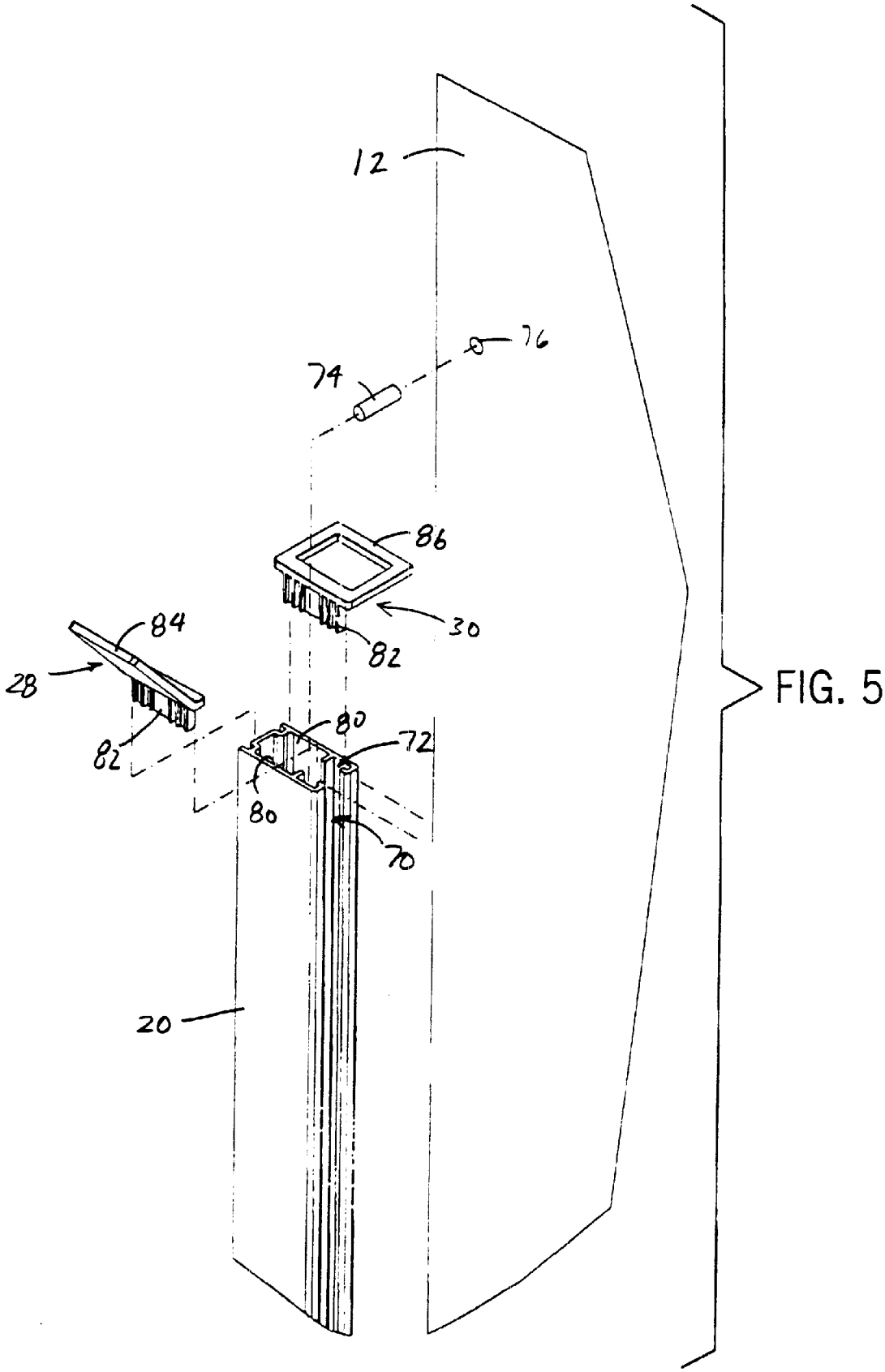
FIG. 5 is a partial exploded view focusing on the wall jamb and related accessories.
Figure 6:
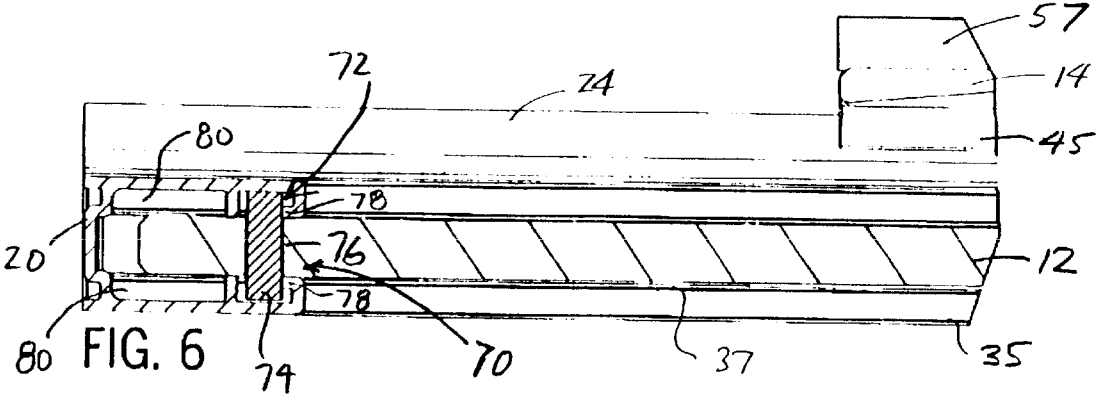
FIG. 6 is a partial cross-sectional view taken along line 6—6 of FIG. 1.
Figure 7:
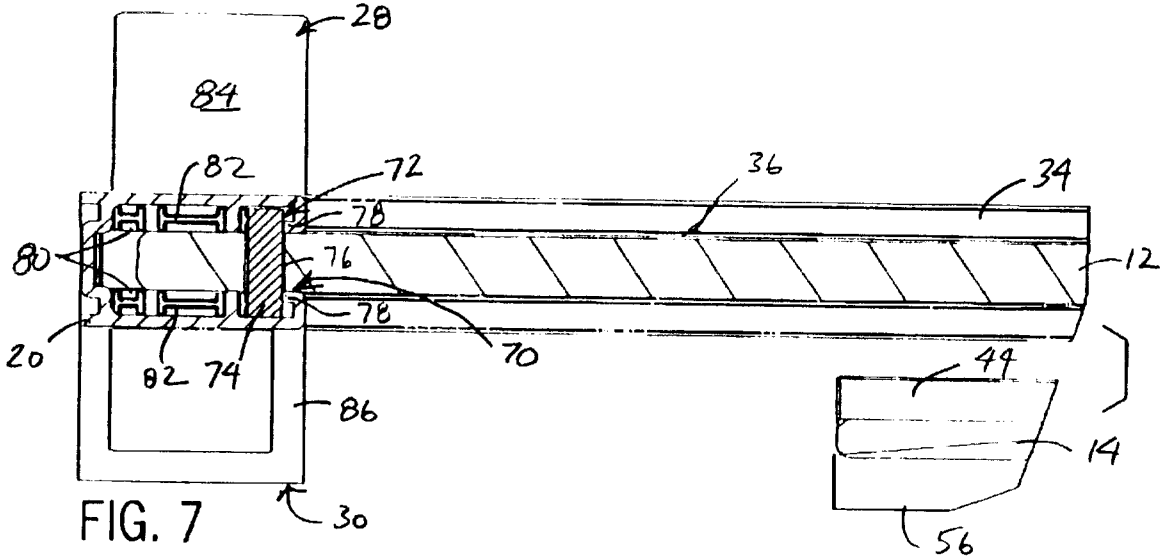
FIG. 7 is a partial cross-sectional view taken along line 7—7 of FIG. 1.

Referring now to FIGS. 5–7, the side panel 12 (and thus the door panel 14) is mounted to a vertical wall of the enclosure via the wall jamb 20. In particular, the wall jamb 20 is mounted to the wall via three conventional anchors (not shown). The wall jamb 20 is generally C-shaped with a lengthwise opening 70 at its inner edge. The inner profile of the wall jamb 20 defines a track 72 adjacent the opening 70 and running the length of the wall jamb 20. The track 72 receives a jamb pin 74 that is disposed through an opening 76 near the pivot edge of the panel 12. The wall jamb 20 extends to a lesser height than the side panel 12 (and thus the enclosure opening) so that the jamb pin 74 and the side panel 12 can be slid into the track 74 from the open upper end of the wall jamb 20, the opening 76 being located at the proper height to accommodate this without the top of the side panel 12 hitting the ceiling.

The weight of the side panel 12 will pull the jamb pin 74 against the outwardly extending legs 78 of the track 72 (see FIG. 6) and through friction help secure the side panel 12 in place with the bottom of the side panel in the stationary hinge 35 resting on the threshold 24. The side panel 12 can thus be installed in the wall jamb 20 without clamping, screwing or applying an adhesive.

The shortened wall jamb 20 also provides additional benefits. First, it can be installed in one-piece wall surround units that are shorter than the full height of the enclosure opening, as well as in application where the walls are partially tiled less than the full height of the enclosure opening. The short wall jamb can be fastened directly to the tile or wall of the surround unit without extending above the top of the unit, thereby eliminating the need to bend the jamb to avoid having an unsightly gap between the enclosure wall and the jamb. Moreover, unlike conventional shower doors in which the top hinge is mounted to the enclosure wall at or near the top of the side panel, the invention allows a hinged door to be used with a surround unit without building out the wall or otherwise adding material to support the top hinge.

The shortened wall jamb 20 also provides for an accessory mounting at an appropriate height for a person standing in the enclosure. Referring to FIGS. 5 and 7, the inner profile of the wall jamb 20 defines channels 80 that, in addition to the track 72, receive mating ends 82 of the robe hook 28 and razor holder 30 in a friction fit. The robe hook 28 preferably has an upwardly sloped surface 84 for hanging garments and the razor hook 30 preferably has a generally horizontal rectangular ring 86 sized so to support the head of a razor with its handle disposed through the ring 86. These accessory attachments also have upper surfaces with edges that nearly abut the front and back sides of the side panel 12 to effectively cap the upper end of the wall jamb 20, including the track 72. The accessories can be fit into either channel 80, however, preferably the robe hook 28 is in the front channel so that garments hung thereon do not get wet when showering.

Although not shown, if no accessory attachments were desired, the upper end of the wall jamb 20 could be capped by one or more plugs with ends that mate with one or both of the channels 80 and the track 72. Additionally, it should be mentioned that other accessory attachments could be substituted for the robe hook 28 and razor holder 30, for example, a soap dish or a bottle tray.

The side 12 and door 14 panels are preferably glass, and the jamb 20 and striker 22 are preferably extruded aluminum, as is the threshold 24. The hinge backing plates 54 and 55 are preferably brass and the back covers 56 and 57 are preferably an ABS plastic. The stationary hinge elements 34 and 35, hinge bodies/elements 44 and 45 and pivot pins 42 and 43 are preferably either brass or ABS allowing various price options for the consumer. The jamb pin 74 and accessory attachments 28 and 30 are preferably ABS. The T-nuts 64 are preferably stainless steel.

The invention, constructed as in the above-described embodiment, thus provides a shower door assembly that can be mounted in an opening in a shower enclosure having varied opening dimensions. The hinge assemblies allow for adjustment of the door panel with respect to the side panel throughout the length of the slots in the hinge bodies and backing plates. Thus, a single set of side and door panels can be used for a range of enclosure openings. The shower door assembly can also be adjusted quickly and easily to correct for out-of-plumb installations. Moreover, the side panel can be quickly mounted to the wall jamb by simply sliding the jamb pin into the track without requiring tools.

A preferred embodiment of the invention has been described in considerable detail above. However, modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

Industrial Applicability

The invention provides an improved shower door system.

What is claimed is:

1. A shower door assembly, comprising:

a pivotable door panel;

a side enclosure panel;

an upper connector hinge element;

a lower connector hinge element;

an upper transversely movable hinge element having an adjustment slot extending parallel to the panels and a pivot pin receiver extending substantially perpendicular to the panels;

a lower transversely movable hinge element having an adjustment slot extending parallel to the panels and a pivot pin receiver extending substantially perpendicular to the panels;

two of said hinge elements being mounted to the pivotable door panel, and the other two of said hinge elements being mounted to the side enclosure panel;

one of the upper hinge elements being on an upper portion of one panel, the other of the upper hinge elements being on an upper portion of the other panel, and the upper hinge elements being pivotably connected to each other;

one of the lower hinge elements being on a lower portion of one panel, the other of the lower hinge elements being on a lower portion of the other panel, and the lower hinge elements being pivotably connected to each other; and wherein the shower door panel is pivotably mounted relative to the side enclosure panel so it can pivot about an essentially vertical axis relative to the side panel extending through the pivot pin receivers.

2. The assembly of claim 1, wherein the connector hinge elements are on the side enclosure panel and the transversely movable hinge elements are on the shower door panel.

3. The assembly of claim 1, further comprising a pair of pivot pins disposed in the pivot pin receivers, one of the pivot pins cooperating with the upper hinge elements, and the other of the pivot pins cooperating with the lower hinge elements.

4. The assembly of claim 1, wherein both of the connector hinge elements have a vertically extending pocket for receiving an edge of the side enclosure panel.

5. The assembly of claim 1, wherein the side enclosure panel and door panel at least partially overlap.

6. The assembly of claim 1, further including an upright wall jamb mountable to a wall of a shower enclosure.

7. A shower door assembly, comprising:

a pivotable door panel;

a side enclosure panel;

an upper connector hinge element;

a lower connector hinge element;

an upper transversely movable hinge element;

a lower transversely movable hinge element;

two of said hinge elements being mounted to the pivotable door panel, and the other two of said hinge elements being mounted to the side enclosure panel;

one of the upper hinge elements being on an upper portion of one panel, the other of the upper hinge elements being on an upper portion of the other panel, and the upper hinge elements being pivotably connected to each other;

one of the lower hinge elements being on a lower portion of one panel, the other of the lower hinge elements being on a lower portion of the other panel, and the lower hinge elements being pivotably connected to each other; and wherein the shower door panel is pivotably mounted relative to the side enclosure panel so it can pivot about an essentially vertical axis relative to the side panel;

wherein the connector hinge elements are on the side enclosure panel and the transversely movable hinge elements are on the shower door panel;

wherein at least one of the transversely moveable hinge elements is a sub-assembly comprising a T-nut; a backing plate; and a hinge body having a pivot pin receiver and a T-cross section slot closed at one end and open at an opposite end.

8. The assembly of claim 7, further comprising a cover for concealing the backing plate.

9. A shower door assembly, comprising:

a pivotable door panel;

a side enclosure panel;

an upper connector hinge element;

a lower connector hinge element;

an upper transversely movable hinge element;

a lower transversely movable hinge element;

two of said hinge elements being mounted to the pivotable door panel, and the other two of said hinge elements being mounted to the side enclosure panel;

one of the upper hinge elements being on an upper portion of one panel, the other of the upper hinge elements being on an upper portion of the other panel, and the upper hinge elements being pivotably connected to each other;

one of the lower hinge elements being on a lower portion of one panel, the other of the lower hinge elements being on a lower portion of the other panel, and the lower hinge elements being pivotably connected to each other; and wherein the shower door panel is pivotably mounted relative to the side enclosure panel so it can pivot about an essentially vertical axis relative to the side panel;

further including an upright wall jamb mountable to a wall of a shower enclosure;

wherein the wall jamb extends to a height less than the side enclosure panel.

10. A shower door assembly, comprising:

a pivotable door panel;

a side enclosure panel;

an upper connector hinge element;

a lower connector hinge element;

an upper transversely movable hinge element;

a lower transversely movable hinge element;

two of said hinge elements being mounted to the pivotable door panel, and the other two of said hinge elements being mounted to the side enclosure panel;

one of the upper hinge elements being on an upper portion of one panel, the other of the upper hinge elements being on an upper portion of the other panel, and the upper hinge elements being pivotably connected to each other;

one of the lower hinge elements being on a lower portion of one panel, the other of the lower hinge elements being on a lower portion of the other panel, and the lower hinge elements being pivotably connected to each other; and wherein the shower door panel is pivotably mounted relative to the side enclosure panel so it can pivot about an essentially vertical axis relative to the side panel;

further including an upright wall jamb mountable to a wall of a shower enclosure;

further comprising at least one accessory mounted adjacent an upper end of the wall jamb on the wall jamb.

11. The assembly of claim 10, wherein the accessory has an end matable with an inner profile of the wall jamb.

12. The assembly of claim 10, wherein the accessory comprises a robe hook extending in a first direction relative to the wall jamb, and a holder extending in an essentially opposed direction relative to the wall jamb.

13. A shower door assembly, comprising:

a pivotable door panel;

a side enclosure panel;

an upper connector hinge element;

a lower connector hinge element;

an upper transversely movable hinge element;

a lower transversely movable hinge element;

two of said hinge elements being mounted to the pivotable door panel, and the other two of said hinge elements being mounted to the side enclosure panel;

one of the upper hinge elements being on an upper portion of one panel, the other of the upper hinge elements being on an upper portion of the other panel, and the upper hinge elements being pivotably connected to each other;

one of the lower hinge elements being on a lower portion of one panel, the other of the lower hinge elements being on a lower portion of the other panel, and the lower hinge elements being pivotably connected to each other; and wherein the shower door panel is pivotably mounted relative to the side enclosure panel so it can pivot about an essentially vertical axis relative to the side panel;

further including an upright wall jamb mountable to a wall of a shower enclosure;

wherein the wall jamb has an upright track and the side enclosure panel has an opening in which is disposed a jamb pin slidably engaging the track.

14. A wall jamb for a shower door assembly, the jamb comprising a vertically extending main body region having an upper end; a hook mounted to the jamb adjacent its upper end so as to extend in a first direction; and a holder mounted to the jamb adjacent its upper end so as to extend in a second direction essentially opposite the first direction; whereby the hook and holder are mounted in back-to-back relationship to each other on the wall jamb.

* * * * *